United States Patent [19]

Marchetti

[11] 4,384,849

[45] May 24, 1983

[54] APPARATUS FOR TEMPORARILY IMMERSING ARTICLES IN A HOT-WATER BATH

[76] Inventor: Sergio Marchetti, Via Ottoboni, 10, Milano, Italy

[21] Appl. No.: 267,755

[22] Filed: May 28, 1981

[30] Foreign Application Priority Data

Jul. 7, 1980 [IT] Italy ..... 23276 A/80
Oct. 8, 1980 [IT] Italy ..... 25193 A/80

[51] Int. Cl.[3] ..... F27B 15/00; A45B 9/00; C21D 1/00; C12C 3/04

[52] U.S. Cl. ..... 432/197; 134/75; 134/130; 134/154; 134/183; 266/114; 426/412

[58] Field of Search ..... 432/151, 195, 197; 266/114; 134/75, 83, 130, 133, 134, 154, 182, 183; 426/412

[56] References Cited

U.S. PATENT DOCUMENTS

| | | | |
|---|---|---|---|
| 797,171 | 8/1905 | Cerruti | 134/130 |
| 1,172,201 | 2/1916 | Egbert | 134/183 |
| 2,714,257 | 8/1955 | Reading | 134/83 |
| 2,745,419 | 5/1956 | Slingerland | 134/154 |
| 2,892,462 | 6/1959 | Ine | 134/133 |
| 3,053,265 | 9/1962 | Erie | 134/130 |
| 4,306,857 | 12/1981 | Hofstetter et al. | 432/197 |

*Primary Examiner*—John J. Camby
*Attorney, Agent, or Firm*—Karl F. Ross

[57] ABSTRACT

Articles—e.g. foodstuffs wrapped in polyethylene bags—to be subjected to heat treatment in a bath of hot water are dropped from an input conveyor into an elongate tank at an inlet end for entrainment by a circulating flow toward an outlet end. A perforated extraction conveyor partly immersed in the water intercepts the entrained articles and lifts them out of the flow onto an output conveyor for drying and subsequent storage. The entering water may be set in vortical motion by convoluted baffles, converging in the flow direction, for insuring full submersion of the articles to be treated.

7 Claims, 4 Drawing Figures

APPARATUS FOR TEMPORARILY IMMERSING ARTICLES IN A HOT-WATER BATH

FIELD OF THE INVENTION

My present invention relates to an apparatus for the immersion of articles, especially foodstuffs in heat-shrinkable packages, in a bath of hot water for a limited period.

BACKGROUND OF THE INVENTION

Films of plastic material (e.g. polyethylene) conventionally used for such packaging shrink at temperatures below 100° C. so that the use of a hot-water bath is convenient for this purpose. This is normally done with the aid of a conveyor belt dipping below the bath surface at an immersion point and rising above the water level at an extraction point, the speed of the conveyor being so chosen that articles carried thereon remain submerged for the proper period. When the articles to be sealed in such heat-shrinkable bags are of low weight, however, the packages or at least some of them may float on the surface and may therefore move only slowly if at all to the exit point. This will result in a prolonged exposure of articles to the hot water which could be detrimental especially in the case of foodstuffs.

OBJECTS OF THE INVENTION

The general object of my present invention, therefore, is to provide a means for the continuous thermal treatment of a series of articles—particularly foodstuffs sealed in heat-shrinkable packages—by immersion in a hot-water bath with avoidance of any risk of excessive heating.

A more specific object is to provide an apparatus for this purpose provided with means for insuring a full submersion of the articles in the bath throughout a predetermined treatment period.

SUMMARY OF THE INVENTION

In accordance with my present invention, the articles to be treated are deposited in an upwardly open vessel near a hot-water inlet thereof, the water being continuously circulated between the inlet end of the vessel and a remote outlet end to create a unidirectional flow which entrains the deposited articles toward the latter end. The entrained articles are intercepted ahead of the outlet end by a continuously operating conveyor, which is partly immersed in the hot-water flow, for removal from the vessel. Thus, the water acts in the dual role of heating fluid and transport medium.

In order to insure a complete and substantially instantaneous submersion of articles that otherwise might tend to float on the bath surface, I prefer to provide the vessel near its inlet end with turbulence-generating means creating a vortex generally perpendicular to the flow direction in the incoming fluid stream. Such turbulence-generating means may comprise a pair of convoluted baffles which converge in the flow direction and have concave surfaces confronting each other.

BRIEF DESCRIPTION OF THE DRAWING

The above and other features of my invention will now be described in detail with reference to the accompanying drawing in which.

SPECIFIC DESCRIPTION

Figure 1:
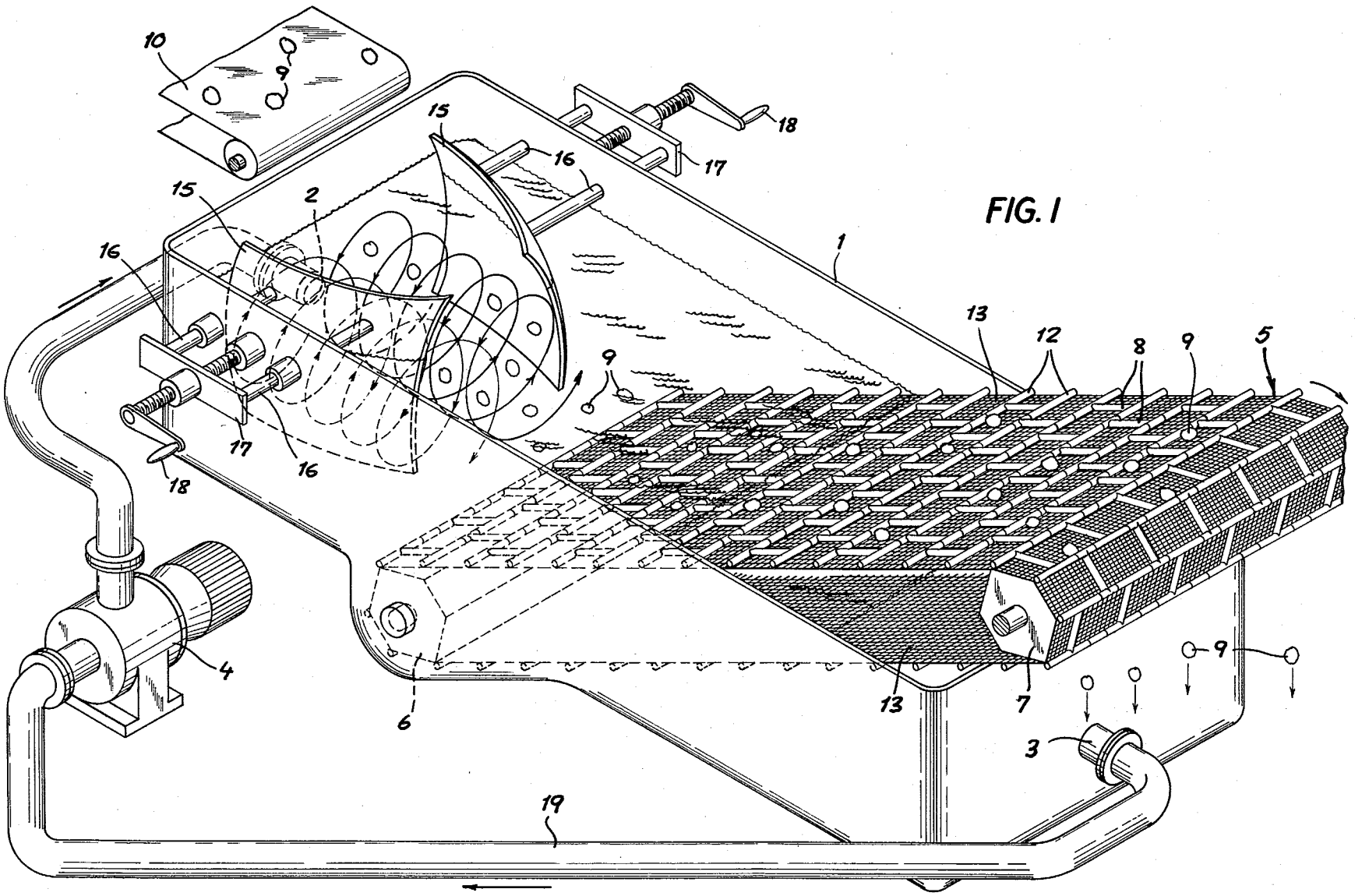
FIG. 1 is a perspective view of part of an apparatus, including an upwardly open vessel, for the heat treatment of articles in accordance with my invention.
Figure 2:
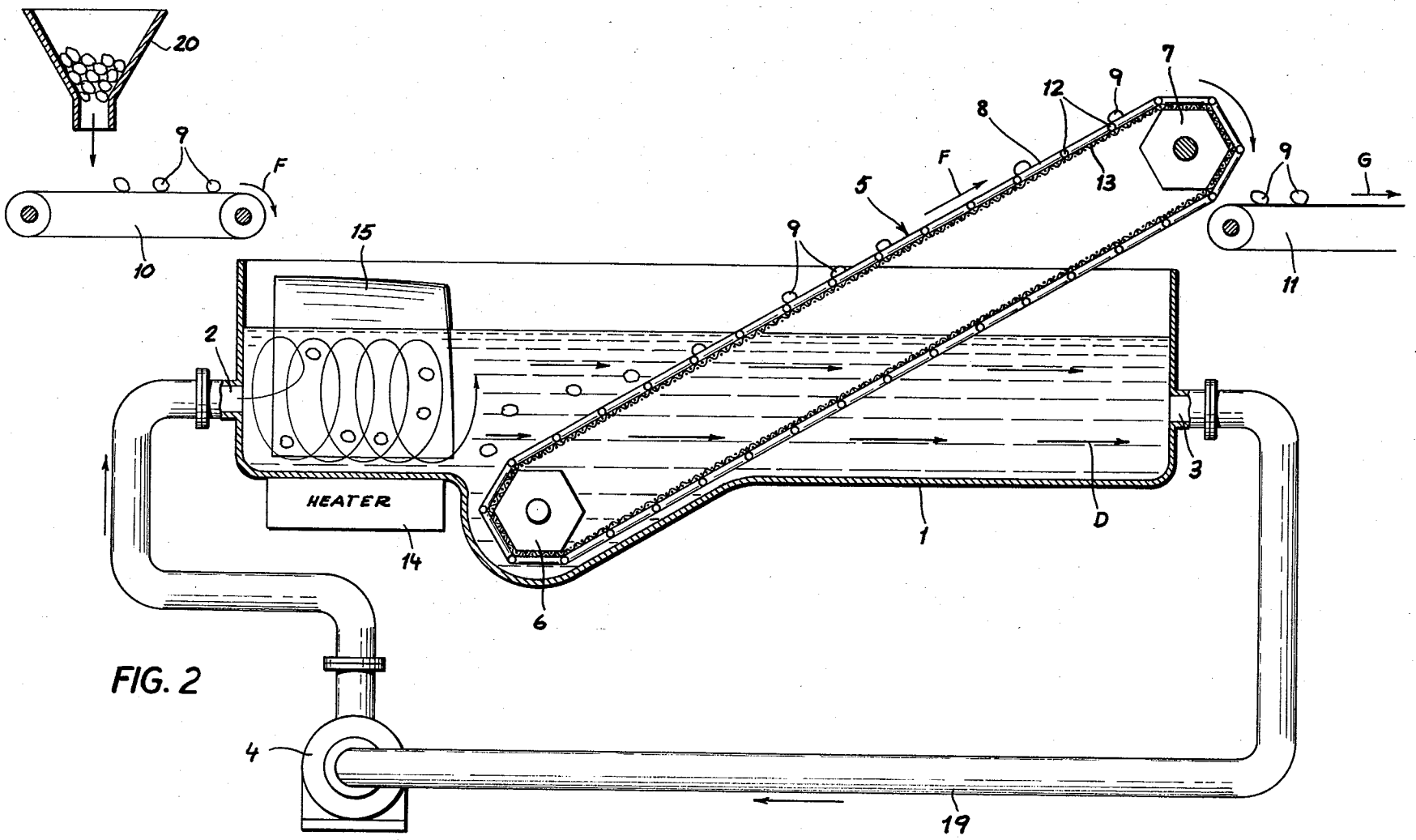
FIG. 2 is a longitudinal sectional view of the vessel of FIG. 1 and also shows, somewhat diagrammatically, other elements of the apparatus.
Figure 3:
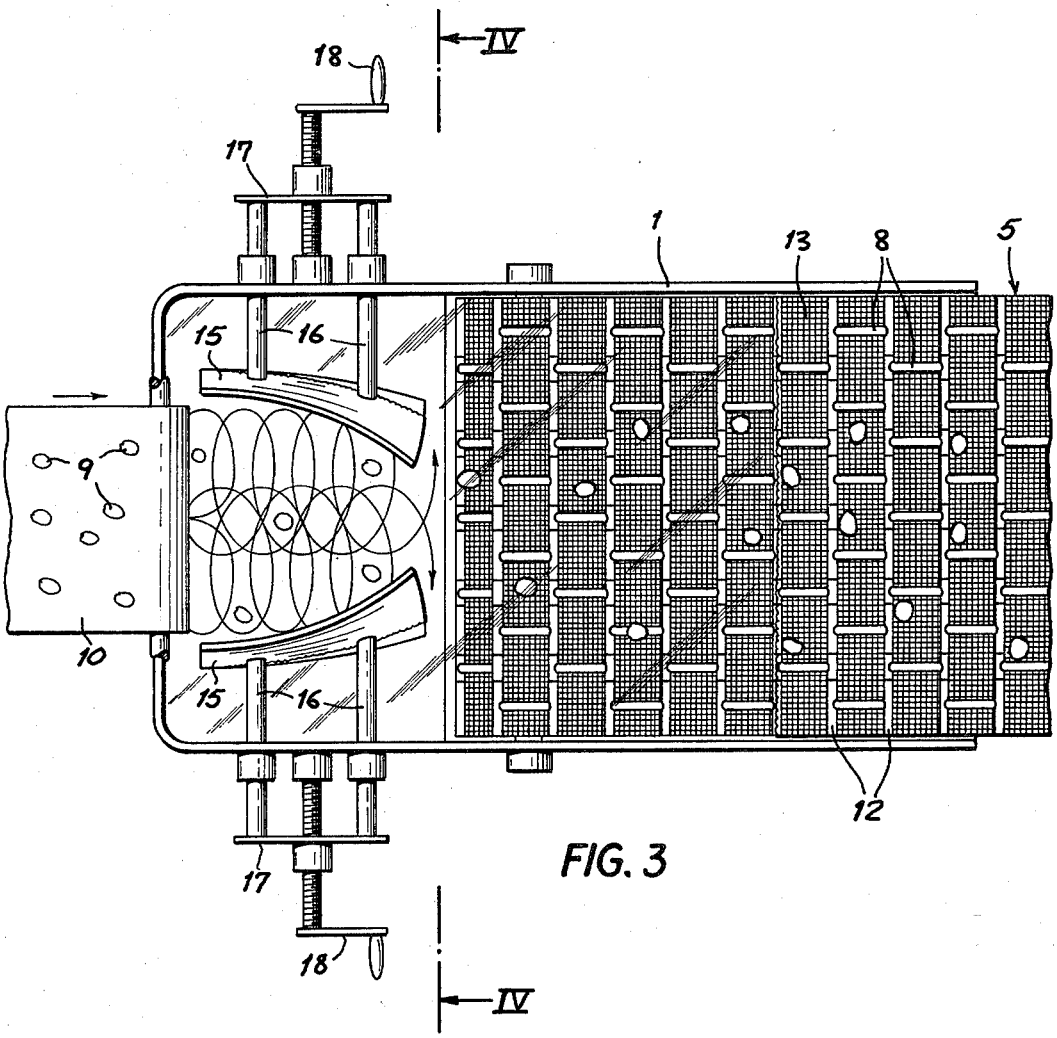
FIG. 3 is a fragmentary top view of the assembly of FIG. 2.

As shown in the drawing, a treatment vessel 1 designed as an upwardly open tank of rectangular outline is provided at one of its short ends with an inlet 2 and at its opposite end with an outlet 3 interconnected by an external conduit 19 including a pump 4 for the continuous unidirectional circulation of a flow of hot water through the vessel. The latter is equipped with a heater 14 for maintaining the water in the tank at a predetermined elevated temperature suitable for the heat-shrinking of polyethylene bags in which foodstuffs are sealed to form articles schematically indicated at 9. These articles are deposited via a hopper 20 on an input conveyor 10, overhanging the inlet end of tank 1, from which they are dropped into the water. Above the outlet end of the tank there is provided an output conveyor 11 overhung by an upper part of an inclined extraction conveyor 5 whose lower part is immersed in the water. All three conveyors are continuously operated, in a direction generally corresponding to that of the water flow as indicated by arrows F and G, by drive means not further illustrated.

Extraction conveyor 5, whose angle of inclination to the horizontal is shown to be approximately 30°, has longitudinally spaced-apart flights constituted by transverse rods 12 which are interlinked by shorter rods 8 articulated thereto so as to form loops larger than the articles 9 to be entrained, the network of rods 8, 12 overlying an endless flexible wire grid 13 wound about a lower roller 6 and an upper roller 7. The meshes of grid 13 are, of course, small enough to prevent the articles 9 from traversing same but are efficiently wide to let the circulating water pass freely through. The immersed part of conveyor 5 intercepts the articles 9 moving with the flow toward outlet 3 and lifts these articles out of the water in order to drop them onto the output conveyor 11 for transportation to a storage bin or some other destination.

Figure 4:
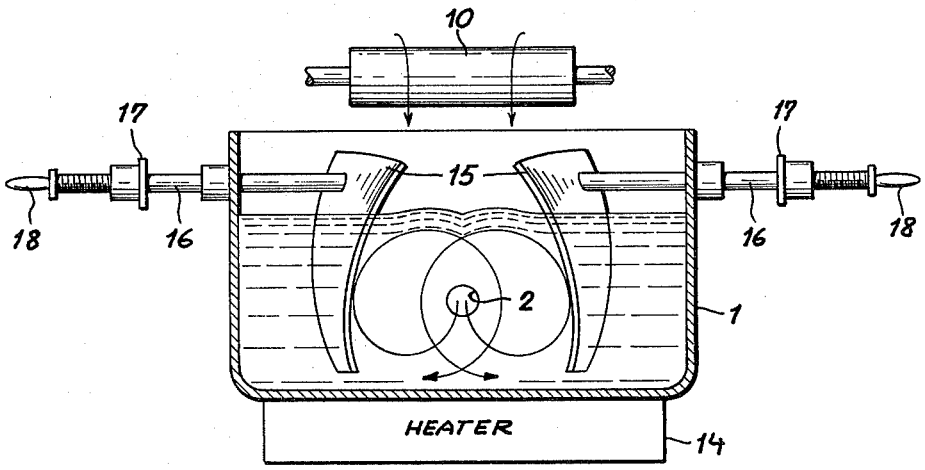
FIG. 4 is a cross-sectional view taken on the line IV—IV of FIG. 3.

As further shown in the drawing, tank 1 is provided near its inlet end with a pair of convoluted baffles 15 which are disposed at opposite sides of input conveyor 10 and converge in the flow direction, these baffles having confronting concave surfaces designed to impart a vortical motion to the incoming flow of hot water. As best seen in FIG. 4, the vortices so generated have downward components near the longitudinal plane of symmetry of the tank whereby the articles 9 dropped from conveyor 10 into the water are immediately drawn under so as to remain submerged until their interception by the rising upper run of extraction conveyor 5. The distance between conveyors 10 and 5 is so chosen, together with the flow velocity of the water, that each article remains in the bath for a period sufficient to shrink the package but not long enough to cause any adverse effects.

The vortex formation can be controlled by a transverse adjustment of baffles 15 which are each shown supported by rods 16 traversing the longitudinal walls of vessel 1 above the water line. The rods 16 are interconnected by a cross-piece 17 threadedly engaging a crank 18 which is rotatably anchored to the vessel wall. This arrangement, of course, is representative of a variety of equivalent mountings facilitating such an adjustment.

Pump 4 could be replaced by other fluid-circulating means such as, for example, a propeller screw disposed near the outlet 3 underneath the extraction conveyor 5.

I claim:

1. An apparatus for subjecting articles to a heat treatment for predetermined periods, comprising:

an upwardly open vessel having an inlet end and an outlet end;

heating and circulation means with conduits externally connected to said vessel at said inlet and outlet ends for creating a continuous, substantially horizontal and unidirectional flow of hot water therein;

an input conveyor overhanging said vessel for continuously dropping articles to be treated into a zone of said vessel near said inlet end for entrainment by the flow toward said outlet end;

a pair of submerged baffles in said vessel flanking said zone, said baffles having downwardly diverging confronting surfaces positioned to create a vortex in said flow insuring full submersion of the articles dropped from said input conveyor; and transport means in said vessel near said outlet end for intercepting the entrained articles and lifting same out of said vessel for removal to a further destination.

2. An apparatus as defined in claim 1 wherein said transport means includes an inclined extraction conveyor partly immersed in said flow.

3. An apparatus as defined in claim 2 wherein said inclined conveyor comprises an apertured endless band with an upper run moving in the general direction of the flow.

4. An apparatus as defined in claim 3, further comprising an output conveyor above said outlet end overhung by said endless band for receiving the articles extracted from the vessel by said extraction conveyor and carrying them to their further destination.

5. An apparatus as defined in claim 2 or 3 wherein said endless band comprises a network with loops formed by articulated rods and a grid with meshes smaller than said loops overlain by said network.

6. An apparatus as defined in claim 1, 2, 3 or 4 wherein said confronting surfaces are concave and converge in the flow direction.

7. An apparatus as defined in claim 6 wherein said baffles are provided with adjusting means for enabling their displacement perpendicular to the flow direction.

* * * * *